US009692148B2

(12) United States Patent
Uehara et al.

(10) Patent No.: US 9,692,148 B2
(45) Date of Patent: Jun. 27, 2017

(54) CONNECTION TERMINAL

(71) Applicant: YAZAKI CORPORATION, Tokyo (JP)

(72) Inventors: Takehiko Uehara, Shizuoka (JP); Takatatsu Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/358,741

(22) Filed: Nov. 22, 2016

(65) Prior Publication Data

US 2017/0149150 A1 May 25, 2017

(30) Foreign Application Priority Data

Nov. 24, 2015 (JP) ..... 2015-228501

(51) Int. Cl.
*H01R 4/58* (2006.01)
*H01R 4/18* (2006.01)
*H01R 4/34* (2006.01)

(52) U.S. Cl.
CPC ..... *H01R 4/58* (2013.01); *H01R 4/185* (2013.01); *H01R 4/34* (2013.01)

(58) Field of Classification Search
CPC ..... H01R 4/58; H01R 4/185; H01R 4/34
USPC ..... 439/801
See application file for complete search history.

(56) References Cited

U.S. PATENT DOCUMENTS

2005/0003703 A1 1/2005 Ono et al.

FOREIGN PATENT DOCUMENTS

JP 2003-203687 A 7/2003

*Primary Examiner* — Alexander Gilman
(74) *Attorney, Agent, or Firm* — Mots Law, PLLC

(57) ABSTRACT

A connection terminal includes: an electric wire connection part; a terminal connection part formed in a flat-plate shape; an insertion hole provided in the terminal connection part and connected to a mated member by insertion of a bolt; an erect wall located around the insertion hole and provided integrally with and protrusively from the terminal connection part; and a fracture part provided at the terminal connection part between the erect wall and the insertion hole and configured to separate a part of the terminal connection part from the mated member by a pull force in a state where the bolt is inserted. The fracture part includes: a first slit provided so as to be partially curved along the insertion hole between the erect wall and the insertion hole; and a second slit provided so as to continue to the first slit and to reach the erect wall.

2 Claims, 5 Drawing Sheets

CONNECTION TERMINAL

The present application claims the priority based on Japanese Patent Application No. 2015-228501 filed on the 24 Nov. 2015, the entire contents of which are incorporated herein by reference.

BACKGROUND

1. Technical Field

The present invention relates to a connection terminal, specifically, to a connection terminal including a flat-plate-shaped terminal connection part to be connected to a mated member with a bolt.

2. Related Art

Conventionally, there has been known a connection terminal that includes an electric wire connection part connected to an electric wire, a terminal connection part provided integrally with the electric wire connection part, and formed in a flat-plate shape; an insertion hole provided in the terminal connection part, and connected to a mated member by insertion of a bolt; an erect wall located around the insertion hole, and provided integrally with and protrusively from the terminal connection part; and a fracture part provided at the terminal connection part between the erect wall and the insertion hole, and configured, to separate a part of the terminal connection part from the mated member by a pull force in a state where the bolt is inserted (e.g., refer to Japanese Patent Application Publication No. 2003-203687).

In the connection terminal, the fracture part is formed as a slit provided so as to be partially curved along an insertion hole between the erect wall and the insertion hole. The slit is fractured by pulling of an electric wire connection part side to a side opposite to an insertion direction of a bolt and thus the electric wire connection part side can be removed from the mated member in a state where an insertion hole side of the terminal connection part is left with the mated member.

The electric wire connection part side is removed by fracturing of the fracture part as described above, and thus the electric wire can be removed from the mated member without any removal operation of the bolt. Namely, recycling can be easily performed and thus recycling properties can be enhanced.

SUMMARY

Incidentally, in the connection terminal described above, the fracture part can be fractured by pulling of the electric wire connection part side to a side opposite to an insertion direction of the bolt or in a direction where the erect wall gets away from the bolt. However, in a case where, for example, the electric wire connection part side is pulled in a direction in which the erect wall gets closer to the bolt, a great force is required for fracturing the fracture part depending on the direction in which the pull force is applied. Therefore, the fracture part cannot be fractured and the connection terminal might be poor in recycling properties.

Accordingly, the present invention aims to provide the connection terminal capable of enhancing the recycling properties.

A connection terminal of the present invention includes an electric wire connection part connected to an electric wire, a terminal connection part provided integrally with the electric wire connection part, and formed in a flat-plate shape; an insertion hole provided in the terminal connection part, and connected to a mated member by insertion of a bolt; an erect wall located around the insertion hole, and provided integrally with and protrusively from the terminal connection part; and a fracture part provided at the terminal connection part between the erect wall and the insertion hole, and configured to separate a part of the terminal connection part front the mated member by a pull force in a state where the bolt is inserted, wherein the fracture part includes: a first slit provided so as to be partially curved along the insertion hole between the erect wall and the insertion hole; and a second slit provided so as to continue to the first slit and to reach the erect wall.

Furthermore, the second slit of the connection terminal of the present invention may include a hole part penetrating through the terminal connection part at a coupling part between the terminal connection part and the erect wall.

BRIEF DESCRIPTION OF DRAWINGS

The invention will now be described with reference to the accompanying drawings wherein.

DETAILED DESCRIPTION

Figure 1:
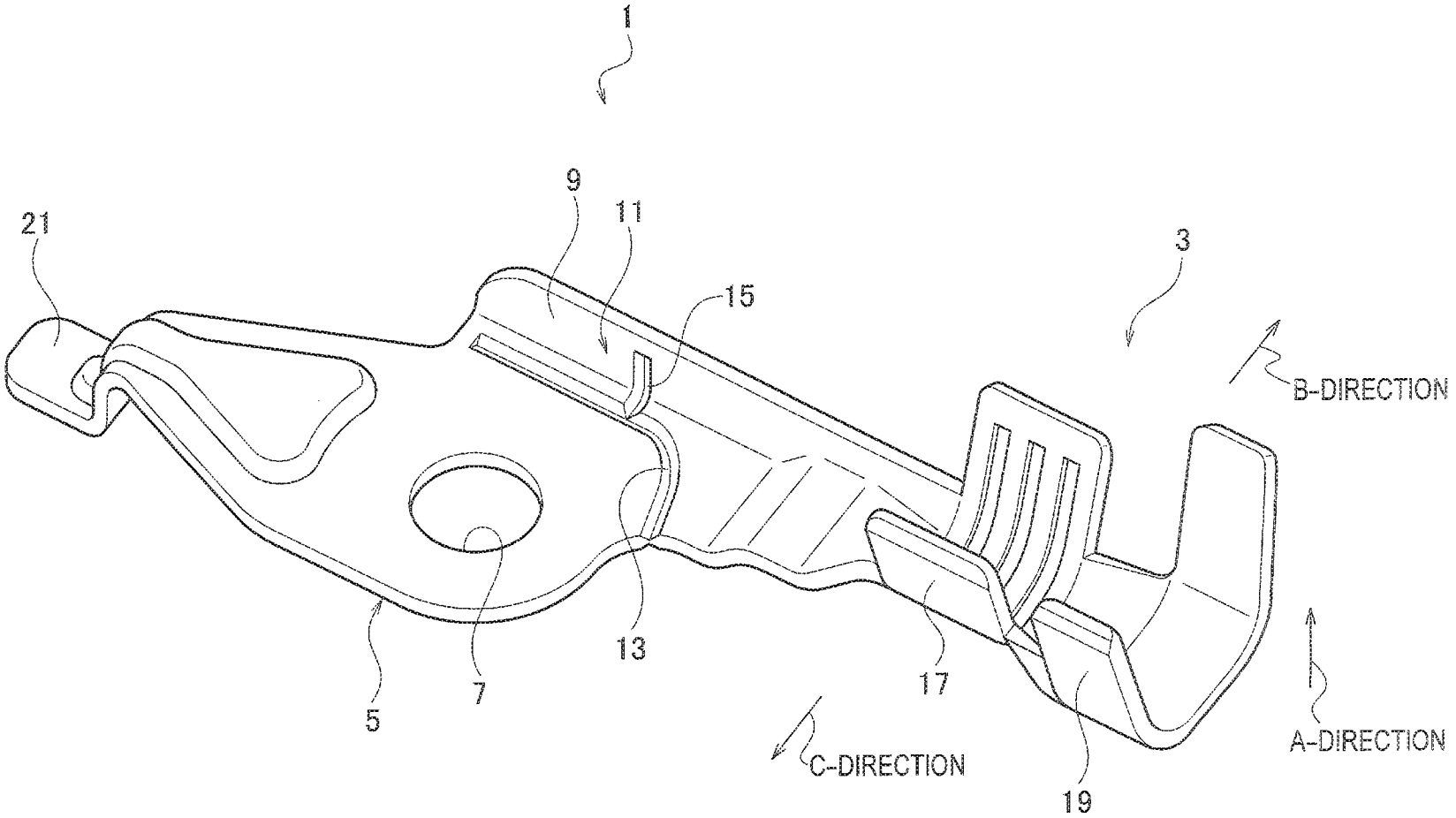
FIG. 1 is a perspective view of a connection terminal according to a first embodiment of the present invention.

A connection terminal according to embodiments of the present invention will be described with reference to FIGS. 1 to 5.

First Embodiment

The first embodiment will be described with reference to FIGS. 1 to 3.

A connection terminal 1 according to the present embodiment includes an electric wire connection part 3 connected to an electric wire, a terminal connection part 5 provided integrally with the electric wire connection part 3 and formed in a flat-plate shape; an insertion hole 7 provided in the terminal connection part 5 and connected to a mated member by insertion of a bolt; an erect wall 9 located around the insertion hole 7 and provided integrally with and protrusively from the terminal connection part 5; and a fracture part 11 provided at the terminal connection part 5 between the erect wall 9 and the insertion hole 7 and configured to separate a part of the terminal connection part 5 from the mated member by a pull force in a state where the bolt is inserted.

The fracture part 11 includes: a first slit 13 provided so as to be partially curved along the insertion hole 7 between the erect wall 9 and the insertion hole 7; and a second slit 15 provided so as to continue to the first slit 13 and to reach the erect wall 9.

Figure 2:
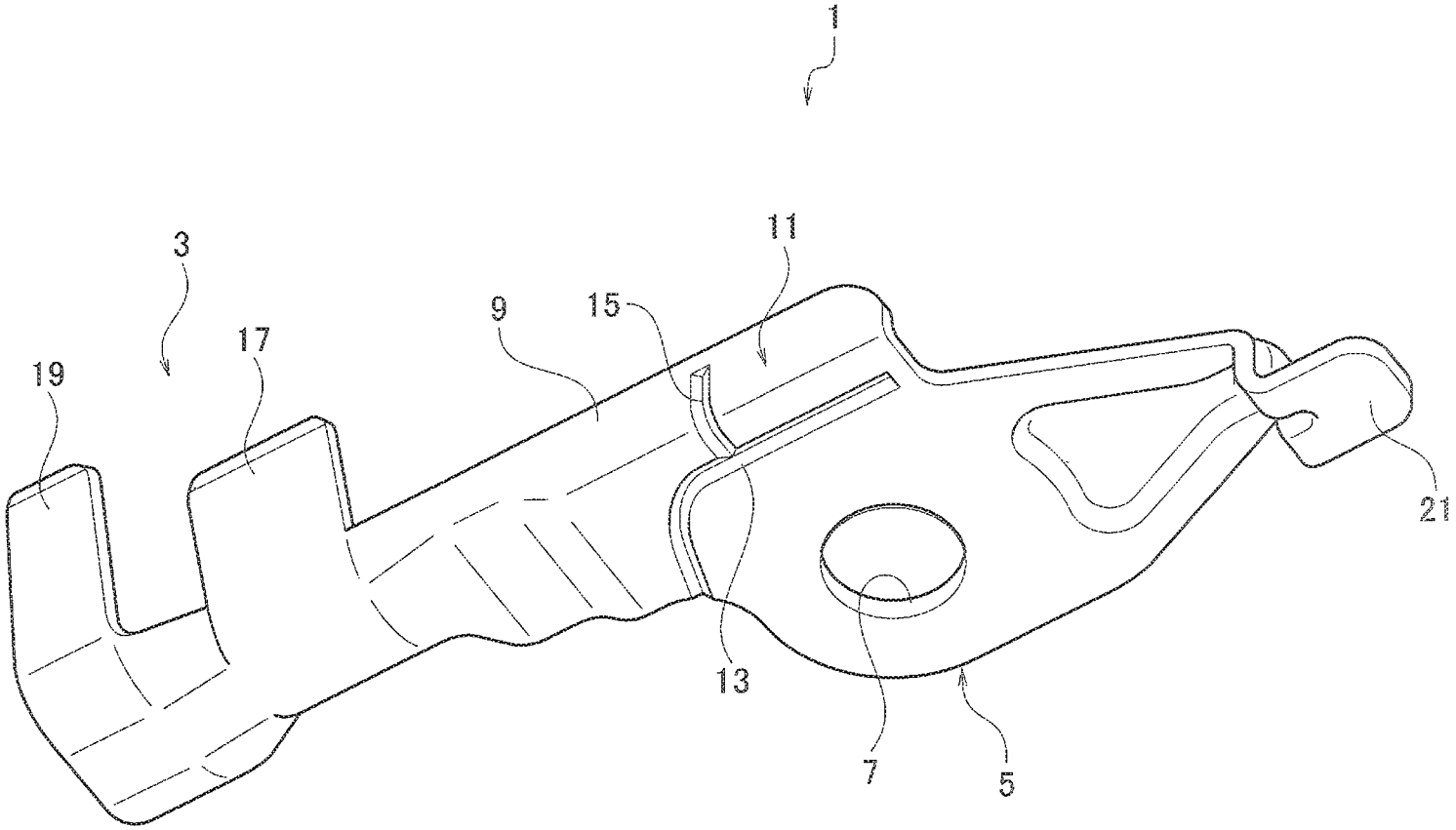
FIG. 2 is a perspective view when viewed from a back side of the connection terminal according to the first embodiment of the present invention.
Figure 3:
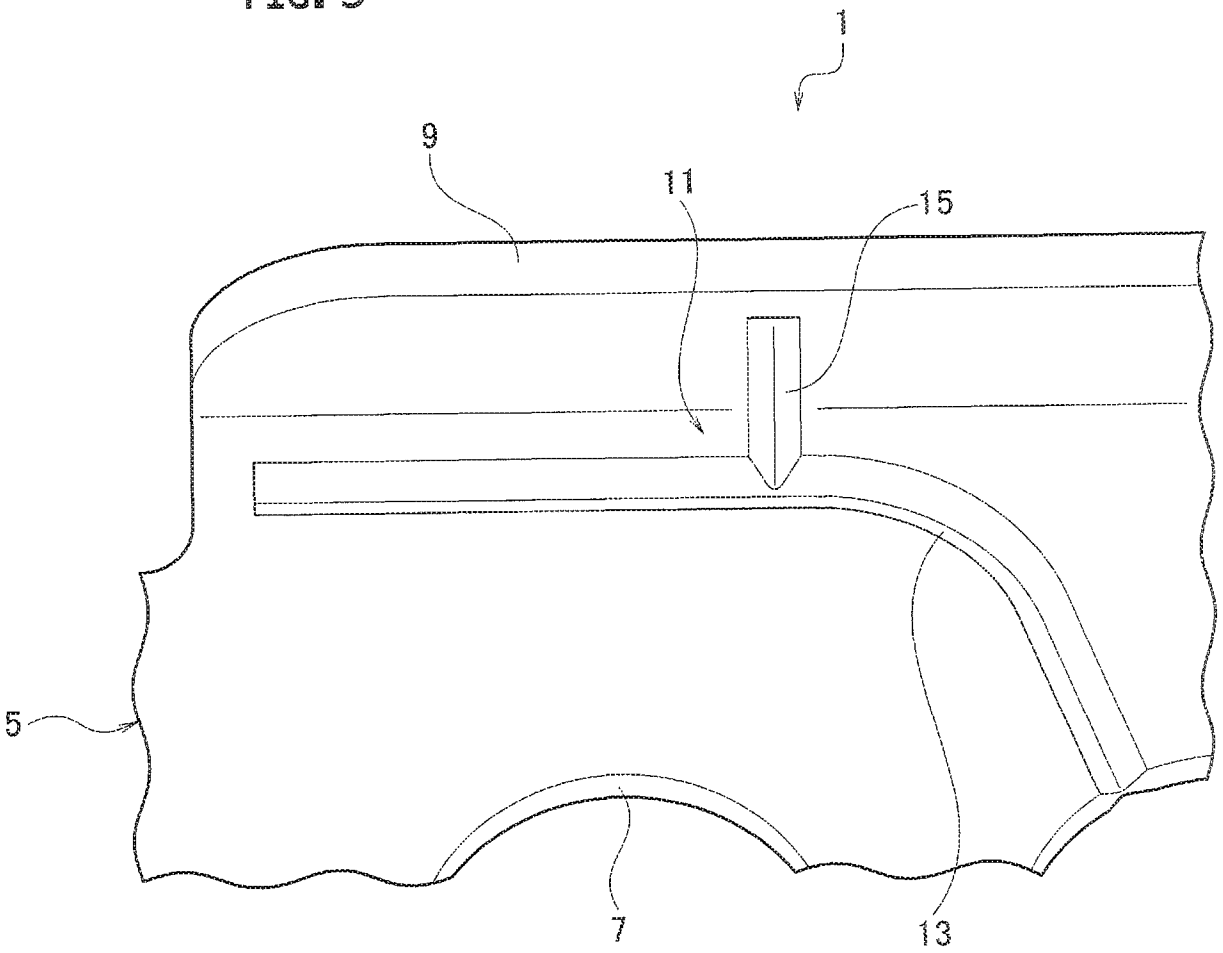
FIG. 3 is an enlarged view of an essential part illustrated of FIG. 1.

As illustrated in FIGS. 1 to 3, the electric wire connection part 3 includes a core wire barrel 17 swaged to a core wire part of the electric wire (not illustrated), and a covering barrel 19 swaged to insulation covering thereof.

The core wire barrel 17 includes a pair of swaging pieces formed with a continuous member on both side surfaces of a bottom wall in a flat-plate shape. The core wire barrel 17 is swaged by a jig or the like to the core wire part exposed from the insulation covering at an end part of the electric wire, to thereby electrically connect the electric wire with the connection terminal 1.

The covering barrel 19 is arranged on an opposite side of the terminal connection part 5 across the core wire barrel 17, includes a pair of swaging pieces formed with a member respectively continuing to both side surfaces of a bottom wall in a flat-plate shape, and is swaged by a jig or the like to the insulation covering of the electric wire to thereby fix the connection terminal 1 to the electric wire.

The electric wire connection part 3 including the core wire barrel 17 and the covering barrel 19 as described above is formed with a member continuous to the terminal connection part 5 via the bottom wall.

The terminal connection part 5 is a member continuous from the bottom wall constituting the electric wire connection part 3, and is formed in a flat-plate shape so as to have a larger area than that of the bottom wall.

The terminal connection part 5 is arranged in a vehicle body (not illustrated) as the mated member, and is electrically connected to the vehicle body by inserting the bolt (not illustrated) into the insertion hole 7.

The insertion hole 7 is provided at a center part of the terminal connection part 5 so as to penetrate through the terminal connection part 5 in a plate thickness direction. The bolt is inserted into the insertion hole 7, the bolt that electrically connects the terminal connection part 5 with the vehicle body. Here, a washer may be interposed between the bolt and the terminal connection part 5.

Note that there is provided, at an end part of the terminal connection part 5 on an opposite side of the electric wire connection part 3, a rotation stop part 21 that engages with the vehicle body and that prevents the connection terminal 1 from rotating with respect to the vehicle body, when the bolt is fastened.

There is provided, around the insertion hole 7, the erect wall 9 that is a member continuous to the terminal connection part 5 and that is protruded from a side surface of the terminal connection part 5.

The erect wall 9 is bent and formed such that a side surface side on a side of the electric wire connection part 3 of the terminal connection part 5 becomes perpendicular to the terminal connection part 5.

The erect wall 9 enhances rigidity of the side surface side on the side of the electric wire connection part 3 of the terminal connection part 5, and suppresses deflection on the side surface side of the terminal connection part 5 when a force is applied to the electric wire connection part 3 due to vibration or the like. Furthermore, when a pull force is applied to the terminal connection part 5 via the electric wire at the time of recycling, the fracture part 11 is made to be easily fractured.

The fracture part 11 is provided at the terminal connection part 5 between the insertion hole 7 and the erect wall 9, and includes the first slit 13 and the second slit 15.

The first slit 13 is formed in a V-letter, groove-like shape at the terminal connection part 5 between the insertion hole 7 and the erect wall 9, on both of a front surface and a back surface, or at least one of them so that a thickness of the terminal connection part 5 is smaller than other parts.

The portion of the first slit 13 from a side of the rotation stop part 21 to the insertion hole 7 is formed in a straight-linear shape along the erect wall 9, and the portion of the first slit 13 from the insertion hole 7 to a side of the electric wire connection part 3 is formed so as to be curved along the insertion hole 7.

In a state where the bolt is inserted through the insertion hole 7 and the terminal connection part 5 is fixed to the vehicle body (mated member), such a first slit 13 fractures when a predetermined pull force is applied to the terminal connection part 5 in an opposite-side direction of an insertion direction of the bolt (hereinafter, referred to as an A-direction), or in a direction where the erect wall 9 gets away from the insertion hole 7 (hereinafter, referred to as a B-direction), and the electric wire can be removed from the vehicle body.

However, when only the first slit 13 is provided, even if a pull force similar to that in the A-direction and the B-direction is applied to the terminal connection part 5 in a direction where the erect wall 9 gets closer to the insertion hole 7 (hereinafter, referred to as a C-direction), the first slit 13 cannot be fractured.

In addition, even if the great pull force is applied in the C-direction to thereby try to fracture the first slit 13, the portion of the connection terminal 1 pulled in the C-direction is wound around the bolt, and a stress applied to the first slit 13 is dispersed, and thus it has been difficult to apply the sufficient stress generated by pulling, to the first slit 13.

Accordingly, the fracture part 11 includes the second slit 15 provided continuously to the first slit 13 in addition to the first slit 13.

The second slit 15 is formed in a V-letter, groove-like shape on both of a front surface and a back surface, or at least one of them so that a thickness of the terminal connection part 5 is smaller than other parts. In addition, an end side of the second slit 15 is continuously provided to the first slit 13, and the other side is provided so as to reach the erect wall 9.

The second slit 15 is located at a part where the stress when the pull force is applied to the terminal connection part 5 in the C-direction is concentrated, in a state where the bolt is inserted through the insertion hole 7 and the terminal connection part 5 is fixed to the vehicle body.

Since the second slit 15 is provided as described above, the fracture can be caused from the second slit 15 when the pull force at a similar level to each of forces in the A-direction and the B-direction is applied in the C-direction. Thus, the electric wire can be removed from the vehicle body without necessity of a great pull force for winding around the bolt.

Note that, as the reference, it is preferable that the pull force required for fracturing the fracture part 11 be set to 500 N or less, but, when the fracture part 11 includes only the first slit 13, the pull force required When pulling in the C-direction is 800 N or more.

On the other hand, when the fracture part 11 includes the first slit 13 and the second slit 15, the pull force required when pulling in the C-direction is approximately 400 N. Since the fracture part 11 includes the second slit 15 in addition to the first slit 13, the fracture part 11 can be fractured without necessity of the great pull force in any directions.

Note that the first slit 13 and the second slit 15 are simultaneously formed at the time of press processing or the like.

In such a connection terminal 1, the fracture part 11 includes the first slit 13 provided so as to be partially curved along the insertion hole 7 between the erect wall 9 and the insertion hole 7, and the second slit 15 provided so as to continue to the first slit 13 and to reach the erect wall 9.

Accordingly, the fracture part 11 can be fractured against the pull force in any direction, by the first slit 13 and the second slit 15.

Therefore, in such a connection terminal 1, the electric wire can also be removed from the mated member against the pull force in any direction and thus the recycling properties can be enhanced.

Second Embodiment

The second embodiment will be described with reference to FIGS. 4 and 5.

In a connection terminal 101 according to the present embodiment, the second slit 15 includes a hole part 103 penetrating through the terminal connection part 5 at a coupling part between the terminal connection part 5 and the erect wall 9.

Note that the same configurations as those of the first embodiment will have the same symbols, and although the configuration and the function description will be omitted with reference to the first embodiment, the same effects can be obtained since the second embodiment has the same configurations as those of the first embodiment.

Figure 4:
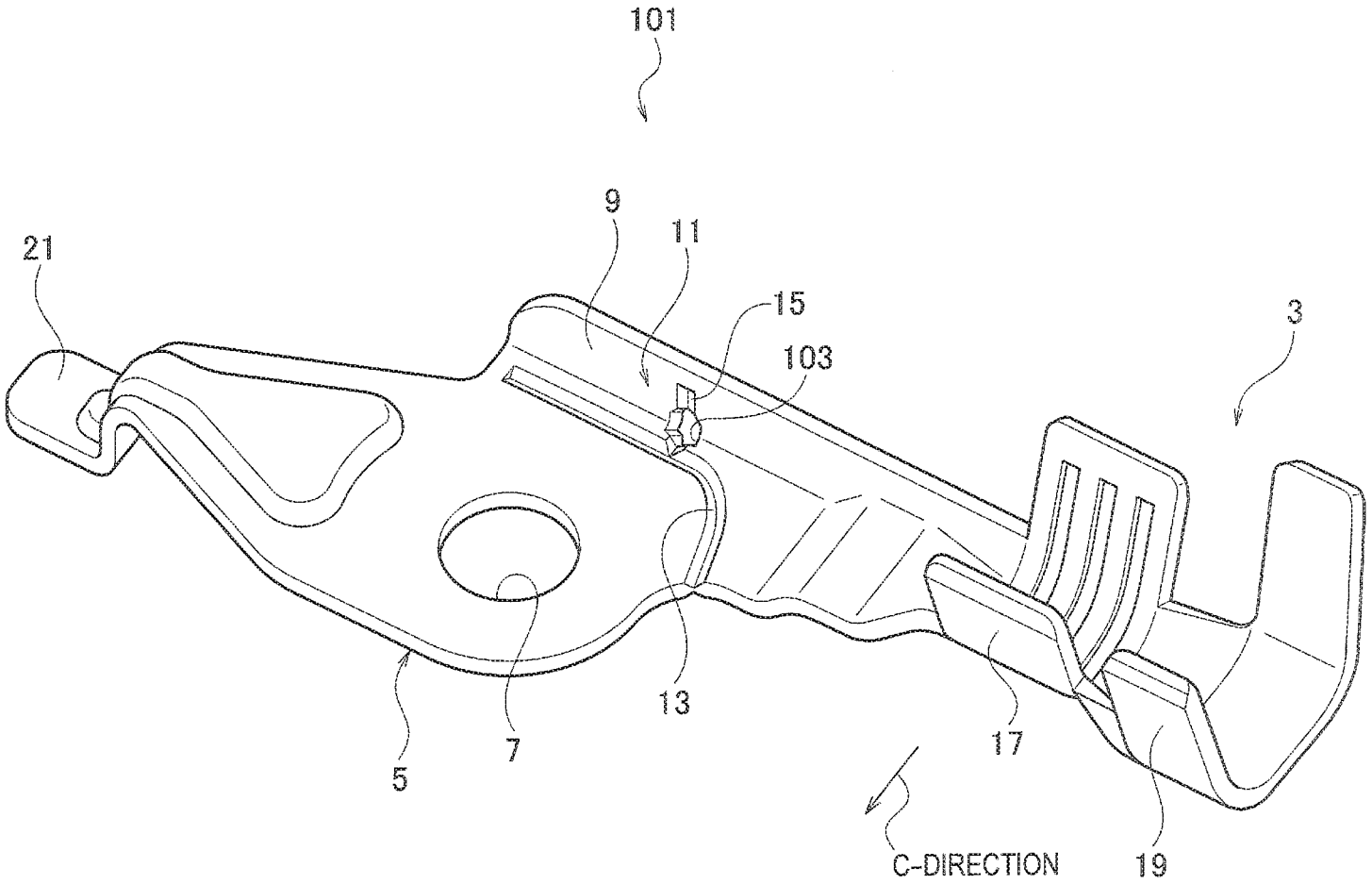
FIG. 4 is a perspective view of a connection terminal according to a second embodiment of the present invention.
Figure 5:
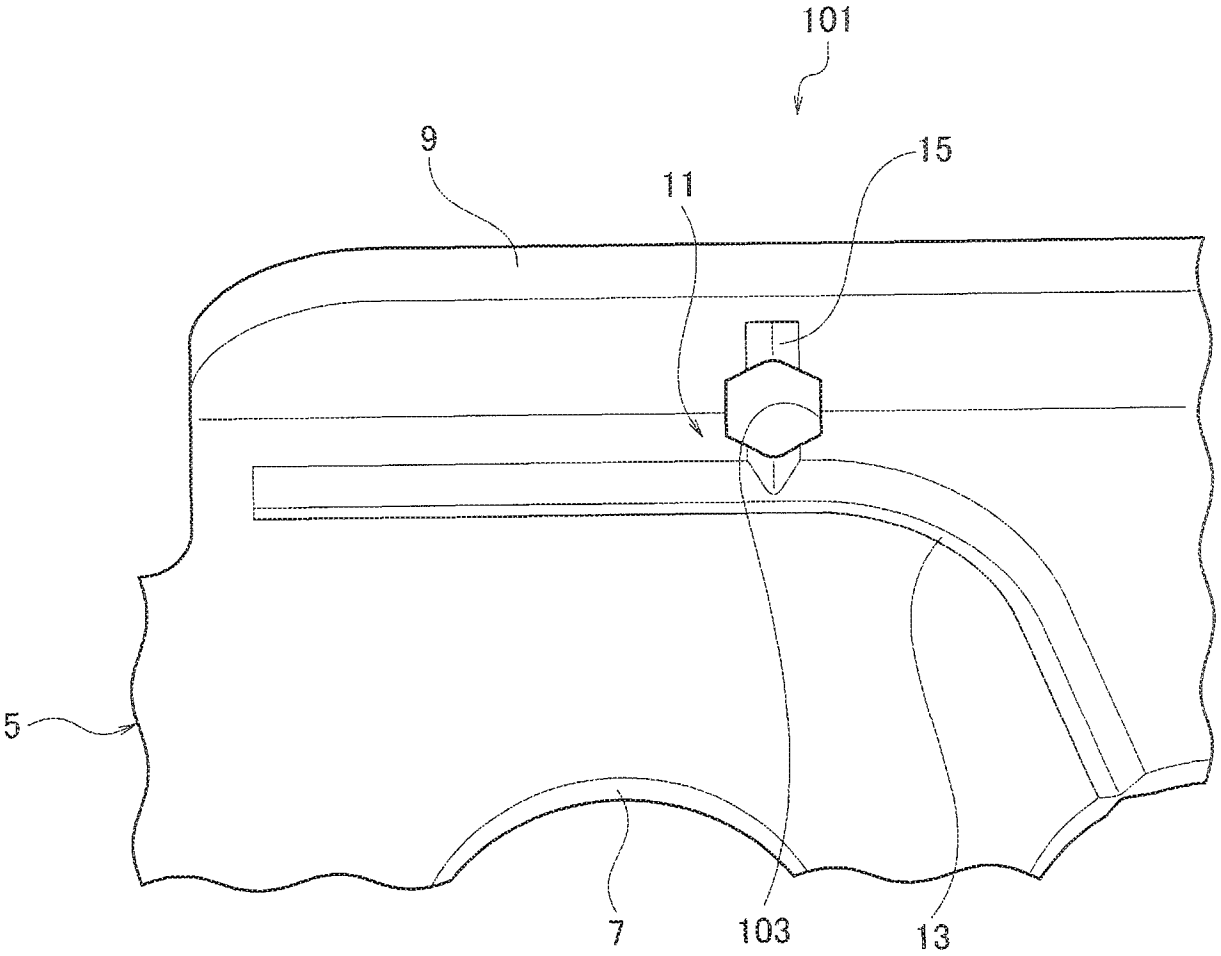
FIG. 5 is an enlarged view of an essential part illustrated of FIG. 4.

As illustrated in FIGS. 4 and 5, the second slit 15 includes the hole part 103 penetrating through the terminal connection part 5 in a plate-thickness direction at the coupling part that is a rising part of the erect wall 9 from the terminal connection part 5.

As described above, in the fracture part 11, the stress can be concentrated around the hole part 103 by provision of the hole part 103 in the second slit 15, when the pull force is applied to the terminal connection part 5 in the C-direction. Accordingly, when the pull force is applied to the terminal connection part 5 in the C-direction, the fracture part 11 can be fractured from a place where there is the hole part 103, and can be fractured with a smaller pull force.

Note that, as a reference, when the fracture part 11 includes the hole part 103 in addition to the first slit 13 and the second slit 15, the pull force required when pulling in the C-direction is approximately 250 N. Since the fracture part 11 includes the hole part 103, the fracture part 11 can be further easily fractured.

Herein, the hole part 103 is formed at the same time when the first slit 13 and the second slit are formed by press processing, to thereby stabilize relative positional relationship between the hole part 103 and the second slit 15.

In such a connection terminal 101, since the second slit 15 is provided with the hole part 103 penetrating through the terminal connection part 5 at the coupling part between the terminal connection part 5 and the erect wall 9, the fracture part 11 can be easily fractured against the pull force, and furthermore, the recycling properties can be further enhanced.

Note that, although the connection terminal according to the embodiments of the present invention is provided with the erect wall only on one side of the terminal connection part, the present invention is not limited to the embodiment, and each erect wall may be provided on both sides of the terminal connection part and each fracture part may be provided at a corresponding part of the erect wall.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the embodiments but includes various modifications, changes, alternative techniques, and the like which can readily he conceived therefrom.

INDUSTRIAL APPLICABILITY

According to the present invention, there are exerted the effects of being able to provide the connection terminal capable of enhancing the recycling properties.

REFERENCE SIGNS LIST

1, 101 connection terminal
3 electric wire connection part
5 terminal connection part
7 insertion hole
9 erect wall
11 fracture part
13 first slit
15 second slit

What is claimed is:

1. A connection terminal comprising:

an electric wire connection part connected to an electric wire, a terminal connection part provided integrally with the electric wire connection part, and formed in a flat-plate shape;

an insertion hole provided in the terminal connection part, and connected to a mated member by insertion of a bolt;

an erect wall located around the insertion hole, and provided integrally with and protrusively from the terminal connection part; and a fracture part provided at the terminal connection part between the erect wall and the insertion hole, and configured to separate a part of the terminal connection part from the mated member by a pull force in a state where the bolt is inserted, wherein the fracture part includes:

a first slit provided so as to be partially curved along the insertion hole between the erect wall and the insertion hole; and a second slit provided so as to continue to the first slit and to reach the erect wall.

2. The connection terminal according to claim 1, wherein the second slit includes a hole part penetrating through the terminal connection part at a coupling part between the terminal connection part and the erect wall.

* * * * *